US005284373A

United States Patent [19]

Watson

[11] Patent Number: 5,284,373

[45] Date of Patent: Feb. 8, 1994

[54] VEHICLE DOOR HANDLE ATTACHING ARRANGEMENT

[75] Inventor: Earl L. Watson, Walled Lake, Mich.

[73] Assignee: Chrysler Corporation, Highland Park, Mich.

[21] Appl. No.: 44,685

[22] Filed: Apr. 12, 1993

[51] Int. Cl.[5] ..... E05C 21/00

[52] U.S. Cl. ..... 292/347; 292/DIG. 64

[58] Field of Search ..... 292/347, 336.3, DIG. 31, 292/231, DIG. 64, DIG. 53, 256

[56] References Cited

U.S. PATENT DOCUMENTS

| | | | |
|---|---|---|---|
| 1,818,317 | 8/1931 | Gilmore | 292/256 |
| 2,582,816 | 1/1952 | Bonnell | 292/256 |
| 2,790,181 | 4/1957 | McCarthy | 4/187 |
| 3,153,553 | 9/1961 | Sandor | 292/336.3 |
| 3,967,844 | 7/1976 | Torii et al. | 292/336.3 |
| 4,038,718 | 8/1977 | Reilhac et al. | 16/110 R |
| 4,475,415 | 10/1984 | Yamamoto | 74/543 |
| 4,588,219 | 5/1986 | Kobayashi et al. | 292/336.3 |
| 4,778,207 | 10/1988 | Gergoe | 292/336.3 |
| 4,838,054 | 9/1989 | Weinerman et al. | 70/208 |
| 4,892,342 | 1/1990 | Newman et al. | 292/347 |
| 4,924,582 | 5/1990 | Keller | 29/434 |
| 5,064,228 | 11/1991 | Bisbing | 292/DIG. 31 X |
| 5,238,276 | 8/1993 | Burns | 292/DIG. 31 |

*Primary Examiner*—Richard E. Moore
*Attorney, Agent, or Firm*—Edward P. Barthel

[57] ABSTRACT

A handle assembly is adapted for installation in a vehicle panel aperture from the outboard side of the panel. The assembly housing has an inboard projecting threaded stem supporting a one-piece L-shaped clip retained thereon in a pre-installation raised position a nut tightened on the stem. The clip comprises a vertically disposed head portion, having a vertical mounting slot receiving the stem, and a horizontally disposed body portion having a pair of fingers projecting toward the panel aperture. Upon the installer positioning the handle member in the panel aperture and loosening the nut, the clip descends in a predetermined manner wherein the fingers engage the aperture lower edge. Tightening the nut advances the clip outboard such that vertically disposed bearing edges thereon are urged into locking contact with the panel aperture flanged boarder.

5 Claims, 4 Drawing Sheets

VEHICLE DOOR HANDLE ATTACHING ARRANGEMENT

BACKGROUND OF THE INVENTION

This invention relates generally to vehicle handles and, more particularly, to an arrangement for attaching a vehicle outside door handle assembly to a body panel.

One example of a prior art outside door handle mounting arrangement presently used on Chrysler Corporation vehicles is shown in the U.S. Pat. No. 4,892,342 issued to Newman et al. on Jan. 9, 1990. Vehicle door handles, such as the Newman et al. handle, are received at the vehicle assembly plant separate from the attaching brackets and fastener end item parts required to mount the handle to the door panel. Such a procedure requires a substantial number of end item parts be handled separately from the door handle together with several manual operations needed to attach the handle to the door panel using the brackets and fastener parts.

SUMMARY OF THE INVENTION

Accordingly, it is a feature of the present invention to provide a novel attaching arrangement for securing a handle assembly in a vehicle panel aperture that is relatively easy, efficient and inexpensive to utilize.

It is another object of the present invention to provide an arrangement for securing an outside handle assembly in a vehicle door panel aperture wherein a unique attaching clip is adapted to be preinstalled on the handle housing by a single threaded fastener thereby reducing the time and labor required for assembly line installation.

The handle assembly, which is installed from the exterior of an apertured vehicle panel, comprises a housing formed with a terminal flange surrounding a central body portion. The body portion is inwardly depressed defining a recess for receiving a flush type release handle. A pair of upstanding brackets are integrally formed on the body portion at fore and aft longitudinally spaced locations so as to pivotally support the handle crankarms.

Clip support portions are integrally formed on the central body positioning a generally L-shaped retaining clip formed with an upstanding head panel an outboard projecting base panel. The clip head panel has an elongated vertical slot receiving an inboard projecting single stem threaded to the housing central body portion. A nut is tightened on the stem fixedly holding the clip on the housing support means in an initial pre-installed position.

An installer inserts a tipped handle assembly in the panel aperture such that the upstanding crankarms on the handle initially project through the panel aperture. The panel aperture has a recessed flanged border providing a longitudinally extending notched juncture adapted to temporally locate the upper edge of the handle housing. As a result, the housing is longitudinally positioned while establishing an installation pivot enabling the installer to rock the housing into the aperture along a predetermined swingline. The positioned housing aligns a pair of inboard projecting upper threaded bolts, which project inboard from the housing backside, to be received in associated vertically extending upper slots formed in corner fillets of the aperture flanged border.

The L-shaped retaining clip of the present invention is adapted to secure the lower portion of the housing terminal flange in the panel aperture. In its pre-installed position, the clip head panel has its opposite side edges provided with inboard projecting orientating tabs having their free ends reverse bent. The clip body panel has a pair of stiffening side rails downturned from the panel sides defining a pair of blade-like runners. A downwardly angled finger extends outboard from the panel a determined dimension beyond the vertical free edge of its associated runner.

Upon the housing being rocked inboard along the swingline, its terminal flange backside seats on the aperture flanged border. The pair of upper bolts are received in associated elongated slots formed in corner fillets of the flanged border and retained by threadably attached nuts. The installer loosens the nut on the housing inboard projecting stem enabling the clip to move downwardly under the influence of gravity to its installed position with the fingers resting on the lower border flange. In its installed position, the clip pair of runner vertical edges are located juxtaposed the inboard surface to the panel flanged border. Upon the installer tightening the stem nut, each runner vertically disposed free edge is urged into load bearing contact with the flanged border inboard surface thereby securing the handle assembly in the panel aperture.

BRIEF DESCRIPTION OF THE DRAWINGS

Other features and advantages of the invention, such as improved appearance and service disassembly, will be evident from the following detailed description of the preferred embodiment of the invention and the accompanying drawings wherein.

DETAILED DESCRIPTION OF THE INVENTION

Figures 1, 2, 3:
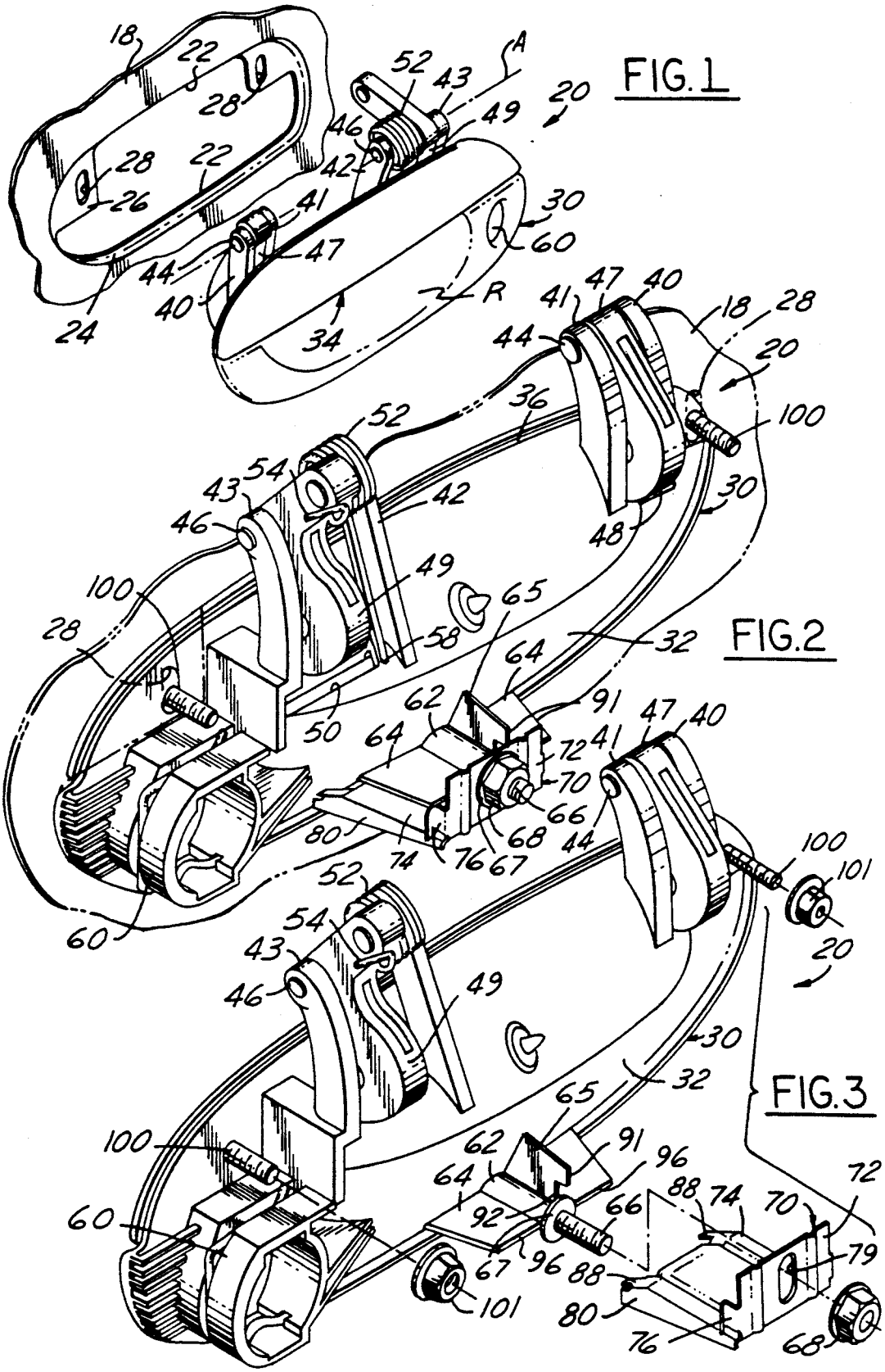
FIG. 1 is a fragmentary exploded perspective view of a door panel aperture and a door handle assembly of the present invention.
FIG. 2 is a fragmentary perspective view of the door panel inboard surface showing the handle assembly mounted in the panel aperture.
FIG. 3 is a perspective view of the inboard side of the door handle housing showing an attachment clip and nut in exploded relation thereto.
Figure 4:
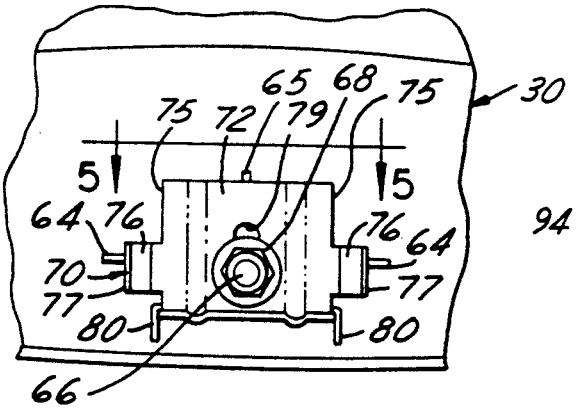
FIG. 4 is a fragmentary view of the inboard central portion of the door handle housing showing the pre-installed attaching clip of the present invention.

Referring now to the drawings, and more particularly to FIG. 1, showing a portion of an automobile sheet metal body door panel 18 and handle assembly 20 positioned prior to mounting the from the outside. FIG. 1 shows an exploded view of the flush type exterior door handle assembly 20 prior to being tipped about a swingline for rocked insertion into elongated aperture 22 configured to accommodate the handle assembly 20 in a flush manner. The panel aperture 22 is defined by a counter-sunk or recessed continuous flanged border 24 off-set or recessed inboard so as to match the panel contour. The flanged border 24 has a pair of upper mirror image corner fillets 26 each provided with a vertically extending mounting slot 28.

Figure 9:
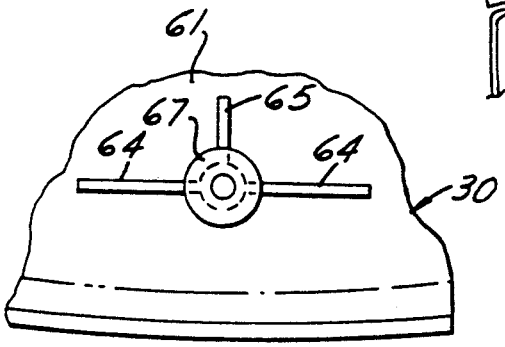
FIG. 9 is a view similar to FIG. 4 with the attaching clip removed.
Figure 10:
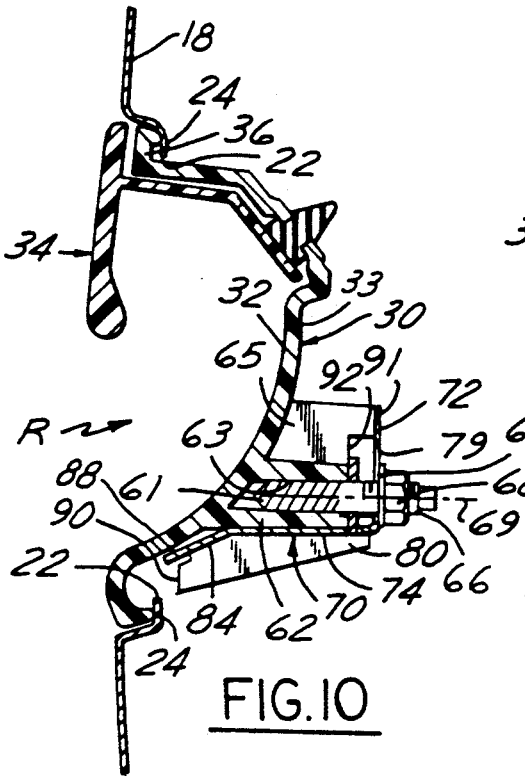
FIG. 10 is a fragmentary vertical cross sectional view, partly in elevation, taken on a vertical cross section through the principal axis of the threaded stud of FIG. 6 showing the attaching clip held in its preinstallation mode.

With reference to FIGS. 1 and 2, the handle assembly 20 includes a housing member 30 formed with a central inboard depressed body portion 32, having a convex surface 33, defining an outboard facing generally oval-shaped central recess "R" (FIG. 1). The recess "R" is sized for inserting the operator's fingers behind a release handle member, generally indicated at 34, pivotally mounted on the housing for location between an extended operable position and a retracted inoperable position within the recess. FIGS. 1, 9, and 10 show the housing member central recess having an integral continuous terminal flange 36 extending around the periphery of the body portion 32. The flange 34 is adapted to seat in a complementary manner on the exterior surface of the matching flanged border 24.

With reference to FIGS. 1-3, the housing member 30 is preferably molded from a polymeric or plastic mineral filled material. The housing central body portion 32 is integrally formed with a forward upwardly extending pair of brackets 40 and 41 and an aft pair of upstanding brackets 42 and 43. The first pair of brackets 40 and 41, spaced in a relatively close manner, are positioned adjacent the forward end of the housing member. The second pair of brackets 42 and 43, separated by an increased space, are located adjacent the aft end of the housing member. The brackets 40,41 support a forward pivot pin 44 therebetween, aligned on a common longitudinally extending pivotal axis "A", while an aft pivot pin 46 is supported between the aft brackets 43, 44.

FIG. 2 shows the handle member 34 integrally formed with a forward crankarm 47 projecting through a slot 48 in the housing member 30 while an aft crankarm 49 projects through slot 50 in the housing member 30. The first crankarm 47 is pivotally supported on pivot pin 44 extending between the forward brackets 40, 41 while the second crankarm 49 is pivotally supported on pivot pin 46 extending between the aft brackets 42, 43.

Figure 6:
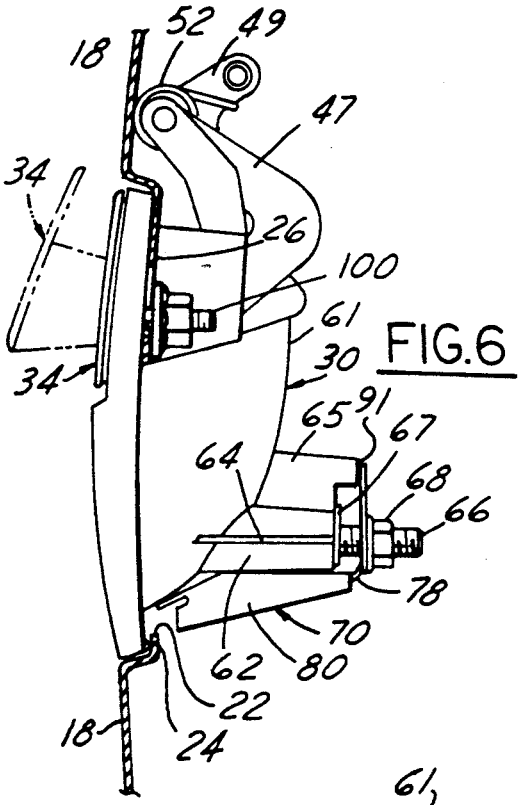
FIG. 6 is a fragmentary end view, partly in section, of the door handle assembly mounted in the panel aperture.

The handle 34 is rotated about the pins 44 and 46 in a clockwise direction, as viewed in FIG. 6, from a gripping solid line position in the housing member recess to its release operating dashed-line position. The handle is raised against the biasing force of a helical spring 52 coiled around the aft pivot pin 46 to actuate door opening latch mechanism (not shown). FIG. 2 shows the spring 52 having one end 54 hooked to the bracket 43 and its other end 56 received in a groove 58 formed in the housing member biasing the gripping portion of the handle toward its inoperative flush position. The spring 52 is in pressure contact with the pin 46 so as to transfer its reaction force thereto.

It will be noted in FIGS. 2 and 3 that an integral cylindrical shaped hollow socket portion 60 is shown formed adjacent the aft end the housing body portion 32 for the reception of a conventional lock cylinder 59 as shown in the handle of the above mentioned Newman patent U.S. Pat. No. 4,892,342, for example. In accordance with conventional practice, vehicle outside door handles for sedan rear doors omit a lock cylinder.

With reference to FIGS. 9 and 10, it will be seen that inboard convex surface 33 of the body portion 32 is formed with an integral inboard extending central spindle portion 62 having a blind bore 63 in its free end centered on the spindle axis 69 (FIG. 10). The spindle 62 has a pair of horizontally disposed mirror image gussets 64 integrally molded therewith and extending in a common horizontal plane from either side of the spindle 62. A central rib 65, upstanding from the spindle, is formed in a vertically disposed plane which includes the spindle axis 69. The spindle blind bore 63 is shown fixedly receiving therein a tapping screw shank 61, formed with an enlarged intermediate radial collar 67. The collar separates the screw shank 61 from an externally threaded stem 66 on its opposite inboard end adapted to receive a flanged nut 68.

Figure 15:
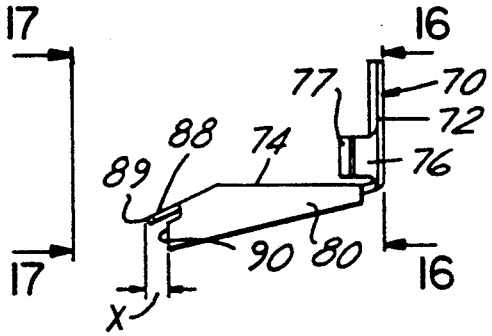
FIG. 15 is a side view of the clip of FIG. 12.
Figure 16:
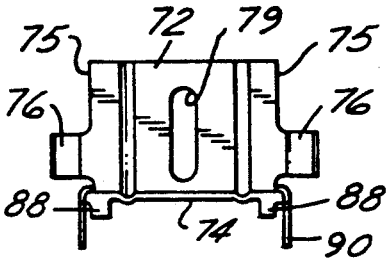
FIG. 16 is an end view of the clip taken in the plane 16—16 of FIG. 15.
Figure 17:
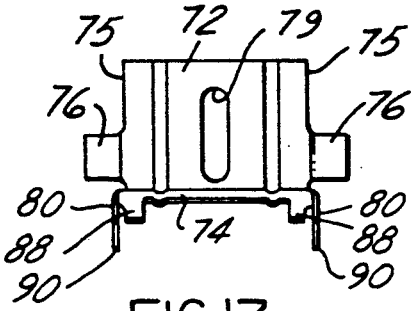
FIG. 17 is an end view of the clip taken on the line 17—17 of FIG. 15.
Figure 18:
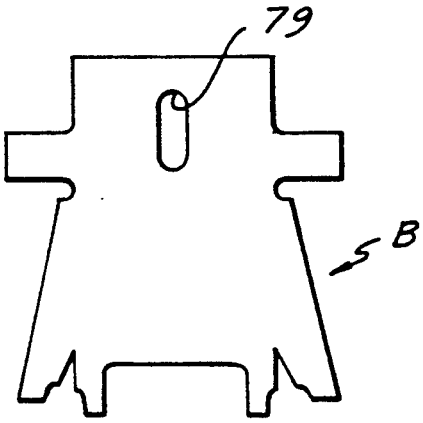
FIG. 18 is a plan view of the sheet metal blank from which the attachment clip of FIGS. 12 is formed.

As viewed in FIGS. 2 and 3, the handle housing fastening arrangement of the present invention comprises a one piece retaining member or clip, generally indicated at 70, formed from sheet metal stock. The clip 70 is initially in the form of a stamped flat blank "B", shown in FIG. 17, and is subsequently formed by suitable stamping machine dies to the clip configuration of FIGS. 14-16.

Figure 11:
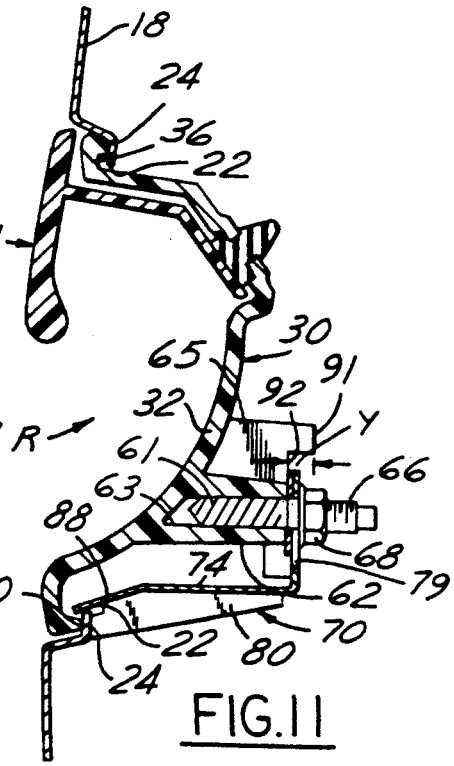
FIG. 11 is a view similar to FIG. 10 showing the clip in its fully installed position.
Figure 12:
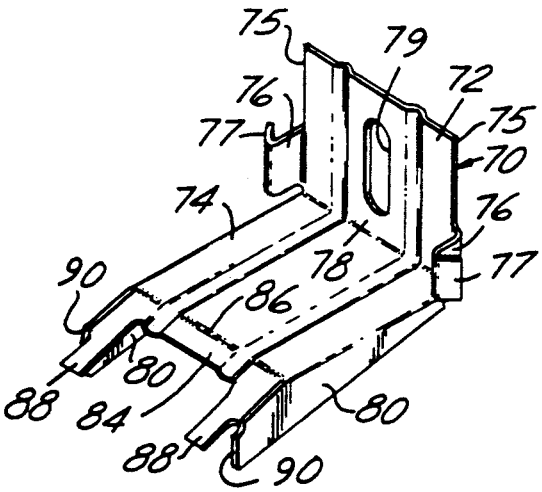
FIG. 12 is an enlarged detail perspective view of the attaching clip of the present invention in its upright position.
Figure 14:
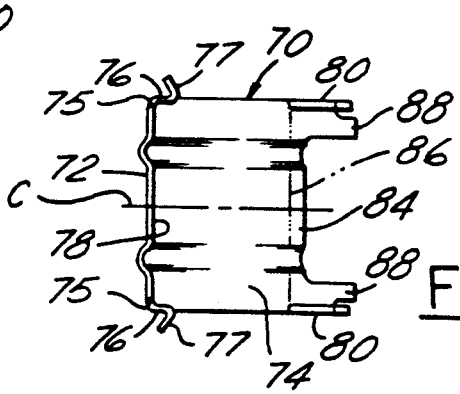
FIG. 14 is a top plan view of the attaching clip of FIG. 11.

The clip 70, as best seen in FIGS. 11 and 12, has a generally right angle or L-shape in vertical cross section comprising an upstanding head panel 72 and a body panel 74 both being generally rectangular and formed symmetrically about a vertical plane of symmetry defined by dashed construction line "C" in FIG. 14. The head panel has its opposite side edges 75 each provided with mirror image parallel orientating guide tabs 76 having their free ends provided with reverse bends at 77. The pair of tabs 76 extend normally from the outboard facing surface of the head panel 72 and are located adjacent the transverse right angle bend line 78 of the clip 70. A center, vertically elongated slot 79 is provided for vertical guided movement of the clip 70 upon receiving therethrough the free end of the housing threaded stem 66 in a manner to be explained.

Figure 13:
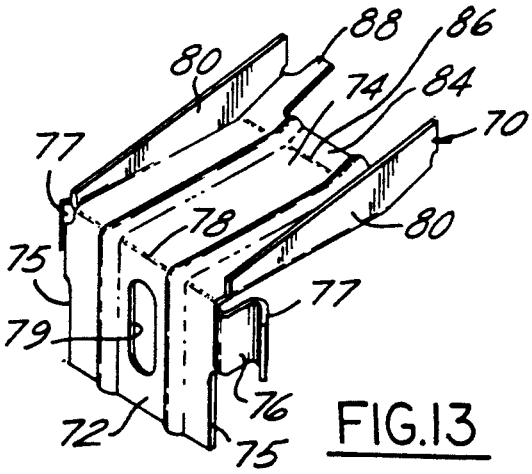
FIG. 13 is a view similar to FIG. 12 showing the attaching clip inverted.

The clip body panel 74 has each of its pair of side edges formed with an integral side rail 80 downturned at a right-angle therefrom. It will be noted in FIG. 13 that each side rail 80 is substantially co-planar with its associated head panel guide tab 76. In addition, a downwardly inclined laterally extending beveled flange 84 is integrally joined at transverse juncture 86 along the free edge of the base panel 74. Further, a pair of elongated beveled fingers 88 are provided at opposite ends of the bevel flange 84 as a continuation thereof. It will be seen in FIG. 14 that each finger free end 89 is positioned a predetermined dimension "X" beyond each side rail vertically disposed outboard bearing edge 90. The bevel flange 84 defines a smooth upwardly facing surface which seats on opposed surface 61 of the handle body portion 32.

Figure 5:
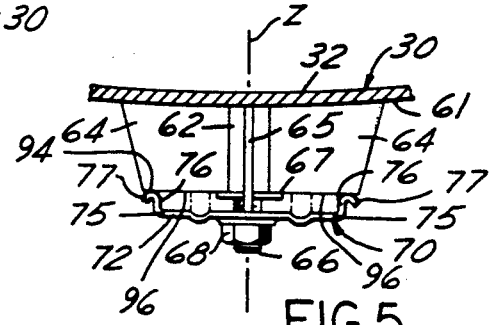
FIG. 5 is a fragmentary top view, partly in section, taken on the line 5—5 of FIG. 4.

As depicted in FIG. 10, the clip head panel central vertical slot 79 is adapted to receive the threaded stem 6 for fixed retention of the clip member 70 in a pre-installed raised position upon initial tightening of the nut 68 on the stem. It will be seen in FIG. 11 that the vertically disposed rib 65 has an upper inboard extending ear 69 defining a vertical upper edge 91. It will be sen in FIG. 11 that the upper edge 91 projects inboard a predetermined dimension "Y" beyond rib lower edge 92. Thus, as seen in FIGS. 5 and 9, the clip 70 is initially pre-installed on the handle member 30 in its uppermost raised position with the stem 66 seated in the radiused lower end of the vertical slot 79. In its initial FIG. 5 position, the clip pair of guide flanges 76 are shown with each of their radiused edges 94 contacting an associated horizontal opposed gusset edge 96. In addition FIG. 5 illustrates the rib vertical upper edge 91 engaging the opposed surface of the clip head panel 74 thereby orienting the head panel 74 in a vertical plane normal to the spindle axis 69.

The handle assembly 20 is installed from the outboard side of the door panel 18 through the panel aperture 22 by initially tilting the handle such that the upstanding crankarms 47 and 49 initially pass therethrough. Next, the handle is rocked into the panel aperture about an arcuate swingline 99 as seen in FIG. 6. Thereafter, a pair of laterally spaced upper bolts 100, fixedly supported in the housing member 30, are inserted in their associated panel slots 28 (FIG. 1) and the terminal flange 36 seated on the panel recessed flanged border 24. Upon installation suitable internally threaded nuts 101 (FIG. 3) are threaded on the ends of each of the bolt studs 100 retaining the handle assembly upper portion in the panel aperture.

Figure 7:
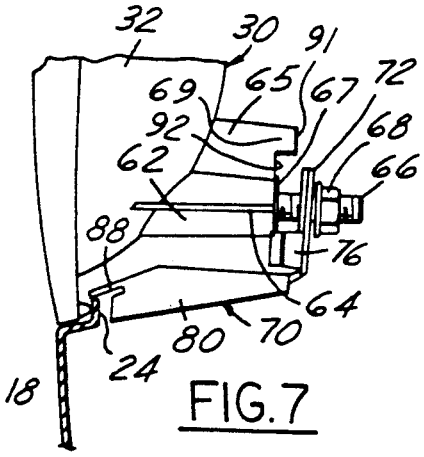
FIG. 7 is a view similar to the lower portion FIG. 6 after the attachment clip nut has been loosened allowing the clip to drop downwardly under the influence of gravity to an intermediate pre-installation mode just prior to the nut being torqued down on its handle housing stud.
Figure 8:
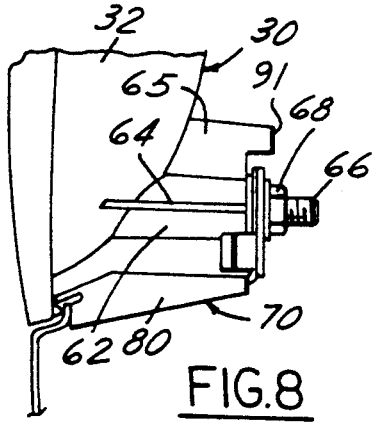
FIG. 8 is a view similar to FIG. 7 after the attachment clip nut has been torqued down on the threaded stud advancing the clip outboard to its final installed position.

The installation of the handle member 30 is completed by releasably locking the lower central portion of the terminal flange 34 to the aperture flanged border 24 by means of the retaining clip 70. Such locking is accomplished by the installer loosening the nut 68 from the inboard side of the door panel 18. This results in the clip 70 descending, under the influence of gravity, in a predetermined downward and outboard path from its initial pre-installed position of FIG. 10 to a predetermined installed position shown in FIG. 7. In FIG. 7 it will be noted that the gravity induced travel of the clip is halted by the fingers 88 engaging the free edge of the aperture lower flanged border 24. It will be noted that, upon completion of the clip head panel's initial vertical decent, the clip panel 72 clears the fin vertical edge 91 while the pair of guides 76 clear the gusset edges 96 thereby freeing the clip for outboard travel to its FIG. 7 panel installed position.

As seen in the clip installed position of FIG. 11, the pair of bearing edges 90 of the side rails 80 are juxtaposed the inner surface of the aperture flanged border 24. Thus, upon the nut 68 being tightened on the threaded stem 66 the bearing edges 90 are clamped against the flanged border inner surface locking the handle assembly in the panel aperture 22.

While there is described above the principles of this invention in connection with a specific embodiment, it is to be clearly understood that this description is made only by way of example and not as a limitation to the scope of this invention.

I claim:

1. In an arrangement for mounting a handle assembly in an automotive vehicle body panel aperture formed with a flanged border, said handle assembly mounting arrangement comprising:

a handle housing formed with a central body portion having a terminal flange presenting a backside thereof, said housing adapted for mounting within the panel aperture with its terminal flange backside adapted to seat on the panel flanged border, and bracket means on said housing pivotally supporting a release handle;

upper fastener means on said housing adapted for securing an upper portion of said terminal flange on the panel aperture flanged border;

said housing body portion having central support means projecting inboard therefrom adapted to guide a retaining clip thereon between a first pre-installed elevated position and a second gravity induced lower installed position;

said clip being generally L-shaped in vertical section comprising an upstanding head panel and a base panel extending outboard from a lower end of said head panel, said support means having a threaded stem projecting inboard therefrom with its free end extending through a vertical slot in said clip head panel, a nut on said threaded stem having an initial torqued setting retaining said clip in said first pre-installed position;

said clip base panel free end terminating in a transverse edge having a pair of fingers projecting outboard therefrom, said base panel formed with downturned side rails each terminating at its outboard end in a vertically disposed bearing edge;

said housing being initially inserted in said aperture from the exterior of said panel with said upper fastening means being received in associated slots means in said panel flanged border;

upon said clip retaining nut being loosened said clip descending under the influence of gravity from its initial pre-installed position to a predetermined position wherein each said finger rests on a lower edge portion of said panel flanged border; and whereby upon said retaining nut being tightened on said threaded stem said clip is advanced outboard to its installed position wherein said pair of side rail bearing edges being urged into contact with an opposed portion of the panel flanged border releasably locking said housing in said panel aperture.

2. The handle assembly mounting arrangement as set forth in claim 1 wherein said housing central support means comprising a spindle extending inboard from said housing body, said spindle formed with first clip support means adapted to position said clip at a predetermined inboard location with said clip in its elevated preinstallation position.

3. The handle assembly mounting arrangement as set forth in claim 1 wherein said clip head panel opposite side edges formed with a pair of mirror image guide tabs, each said guide tabs adapted to contact an associated second clip support means so as to orient said clip head panel in a predetermined vertical plane in said preinstallation position.

4. The handle assembly mounting arrangement as set forth in claim 2 wherein said first clip support means in the form of an upright rib extending upwardly from said spindle located in a vertically disposed plane that includes said spindle axis, said rib defining a lower vertical edge terminating in an inboard extending ear defining an upper vertical edge located inboard a predetermined dimension from said rib lower vertical edge.

5. The handle assembly mounting arrangement as set forth in claim 4 wherein second clip support means in the form of a pair of side gussets extending laterally from each side of said spindle defining a pair of side gussets horizontal edges, each said side gusset located in a second horizontal plane that includes said spindle axis, whereby said rib lower vertical edge together with said pair of side gusset horizontal edges, positioned in a common transverse plane which intersects said spindle axis at right angles.

* * * * *